US007568319B2

(12) United States Patent
Fairbairn

(10) Patent No.: US 7,568,319 B2
(45) Date of Patent: Aug. 4, 2009

(54) LOUVER STYLE ROOF SYSTEM AND METHOD

(76) Inventor: Patrick A. Fairbairn, 2830 S. Duneville St., Las Vegas, NV (US) 89146

( * ) Notice: Subject to any disclaimer, the term of this patent is extended or adjusted under 35 U.S.C. 154(b) by 870 days.

(21) Appl. No.: 11/168,055

(22) Filed: Jun. 29, 2005

(65) Prior Publication Data

US 2007/0000200 A1 Jan. 4, 2007

(51) Int. Cl.
*E06B 7/08* (2006.01)

(52) U.S. Cl. ..... 52/473; 52/18; 52/78; 52/202

(58) Field of Classification Search ..... 52/18, 52/75, 78, 202, 203, 786.1, 473
See application file for complete search history.

(56) References Cited

U.S. PATENT DOCUMENTS 227,920 A * 5/1880 Pohl ..... 49/86.1
2,708,775 A * 5/1955 Maas ..... 52/78
2,797,452 A * 7/1957 Vetere ..... 52/473
2,814,079 A * 11/1957 Van Fleet et al. ..... 52/473
2,952,049 A * 9/1960 Vetere ..... 49/87.1
3,098,267 A * 7/1963 Dean et al. ..... 52/78
3,729,874 A * 5/1973 Albany ..... 52/78
3,803,790 A * 4/1974 Buck et al. ..... 52/473
4,208,846 A * 6/1980 Griebel ..... 52/74
5,306,210 A * 4/1994 Smit ..... 454/250
5,737,874 A * 4/1998 Sipos et al. ..... 49/67
6,536,174 B2 * 3/2003 Foster et al. ..... 52/473

* cited by examiner

*Primary Examiner*—Basil Katcheves
(74) *Attorney, Agent, or Firm*—Jeffrey Weiss; Weiss & Moy, P.C.

(57) ABSTRACT

A patio-style roof system and method. The roof system utilizes a trusses, to which are coupled a plurality of louver panels. To facilitate such coupling, the trusses may have notched louver panel supports, to which the louver panels may be attached in a preferably tools-free manner. The trusses may be coupled to a structure utilizing upper and lower truss attachment brackets.

3 Claims, 4 Drawing Sheets

LOUVER STYLE ROOF SYSTEM AND METHOD

FIELD OF THE INVENTION

The present invention relates to patio roofing systems and, more particularly, to a louver style roof for a patio.

BACKGROUND OF THE INVENTION

Patio roofs come in several styles. Where there is a desire to permit some sunlight to pass through the roof, a slat system will be employed. In this system, typically, a plurality of slats are secured, in parallel rows, to a series of beams projecting at a ninety degree angle from the side a house or other structure. Some spacing is provided between each slat, to provide the desired opening for sunlight.

There are several limitations or drawbacks with systems of this type. Installation is generally labor-intensive, with each slat needing to be affixed in place with nails or wood screws. Achieving proper spacing between slats can be difficult, with the result that truly accurate and consistent spacing may not always be achieved. In addition, the replacement of individual slats can be time-consuming and relatively inconvenient.

The present invention is directed to a roof system for a patio or the like which is relatively simply to install, which eliminates much of the hardware required for prior art systems, that facilitates replacement of individual "slats," and that provides other, related, advantages.

SUMMARY OF THE INVENTION

In accordance with one embodiment of the present invention, a patio-style roof system is disclosed. The system comprises, in combination: at least two trusses; means for securing the at least two trusses to a structure; louver panel supports projecting from the trusses; and a plurality of louver panels detachably coupled to the louver panel supports.

In accordance with another embodiment of the present invention, a patio-style roof system is disclosed. The system comprises, in combination: at least two trusses; wherein each of the at least two trusses comprises a truss body and a series of spaced louver panel supports projecting upward therefrom; wherein the spaced louver panel supports have a notch in an upper, side portion thereof; wherein the panel supports are coupled at acute angles to the truss body; means for securing the at least two trusses to a structure; wherein the securing means comprise an upper truss attachment bracket and a lower truss attachment bracket; a plurality of louver panels detachably coupled to the louver panel supports; a louver panel receiver at an end of each the at least two trusses; wherein the louver panels comprise an upper horizontal section, a lower horizontal section, and an angled section therebetween; wherein the upper horizontal section terminates in a downward protruding tab, and wherein the downward protruding tab is dimensioned to be inserted into the notch; wherein the lower horizontal section terminates in an upward protruding tab, and wherein the upward protruding tab is dimensioned to be inserted into the receiver.

In accordance with a further embodiment of the present invention, a method of installing a patio style roof is disclosed. The method comprises: securing at least two trusses to a structure; wherein each of the at least two trusses comprises a truss body, a series of spaced louver panel supports projecting upward therefrom, and a louver panel receiver at end thereof; wherein the spaced louver panel supports have a notch in an upper, side portion thereof; wherein the panel supports are coupled at acute angles to the truss body; detachably coupling a plurality of louver panels to the louver panel supports; wherein the louver panels comprise an upper horizontal section, a lower horizontal section, and an angled section therebetween; wherein the upper horizontal section terminates in a downward protruding tab; wherein the lower horizontal section terminates in an upward protruding tab; wherein said coupling step comprises inserting the downward protruding tab into the notch and at least one upward protruding tab into the receiver.

DETAILED DESCRIPTION OF THE PREFERRED EMBODIMENTS

Figure 1:
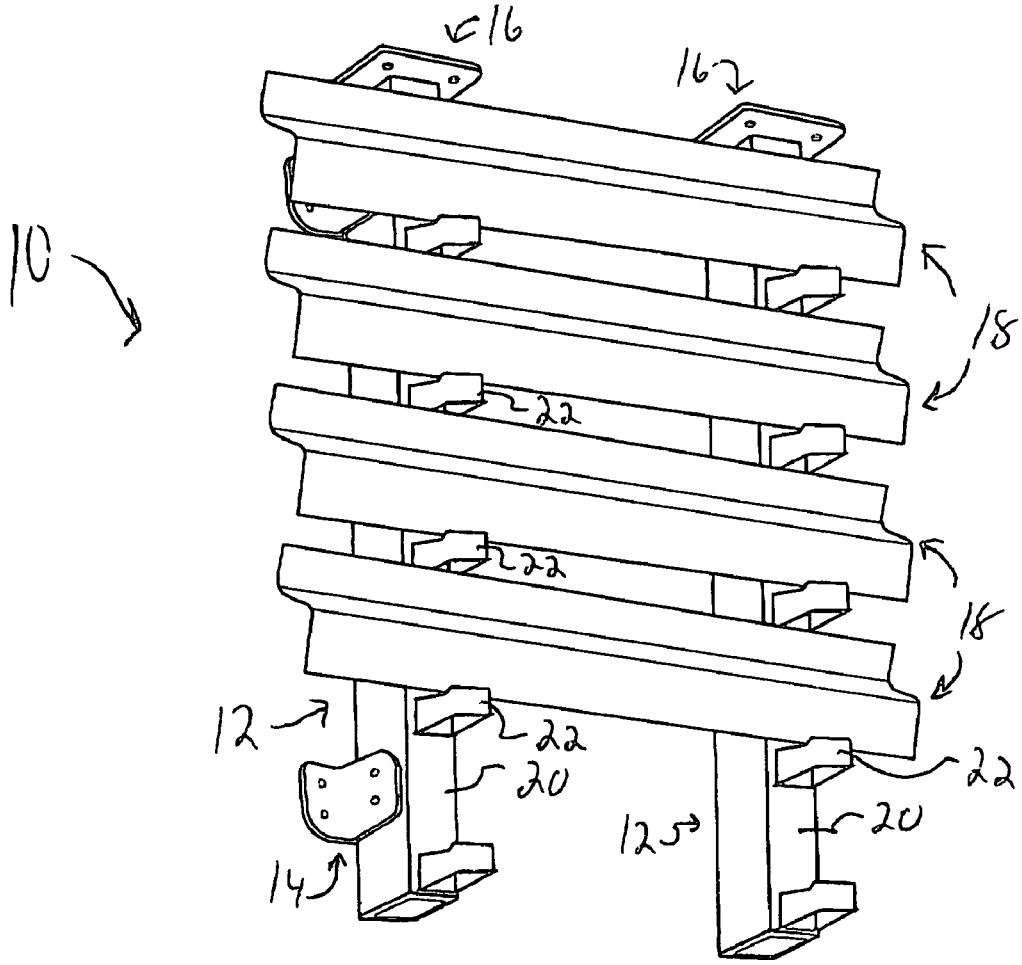
FIG. 1 is a top view of a section of a louver style roof system, consistent with an embodiment of the present invention.

Referring first to FIGS. 1-4, a truss system 10 consistent with an embodiment of the present invention is shown. In this embodiment, the main components of the system 10 are trusses 12, lower truss attachment brackets 14, upper truss attachment brackets 16, and louver panels 18. The purpose of each component and their relationship with each other will now be described in more detail.

Figure 6:
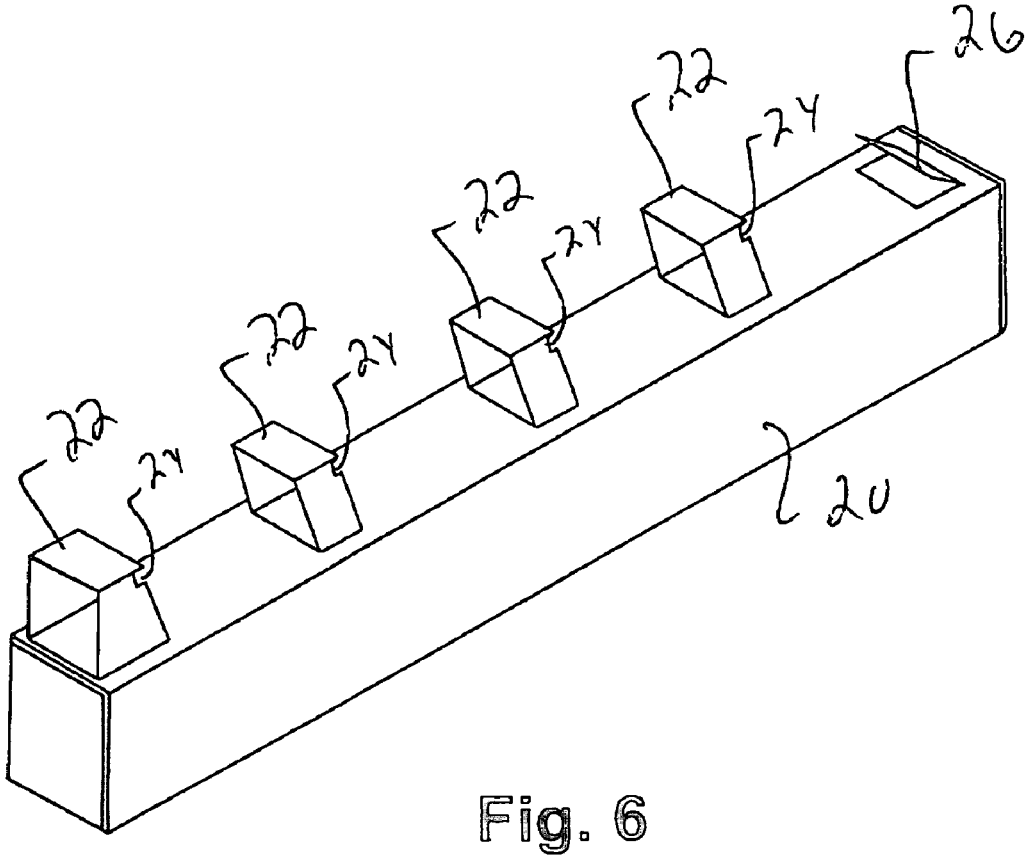
FIG. 6 is a perspective view of a truss component of a louver style roof system, consistent with an embodiment of the present invention.
Figure 7A:
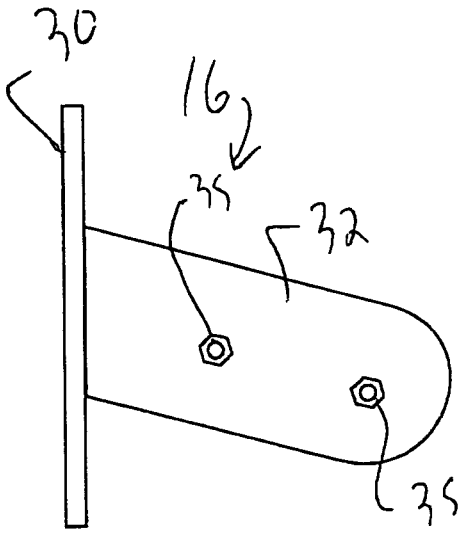
FIG. 7*a* is a side view of an upper truss attachment bracket component of a louver style roof system, consistent with an embodiment of the present invention.
Figure 7B:
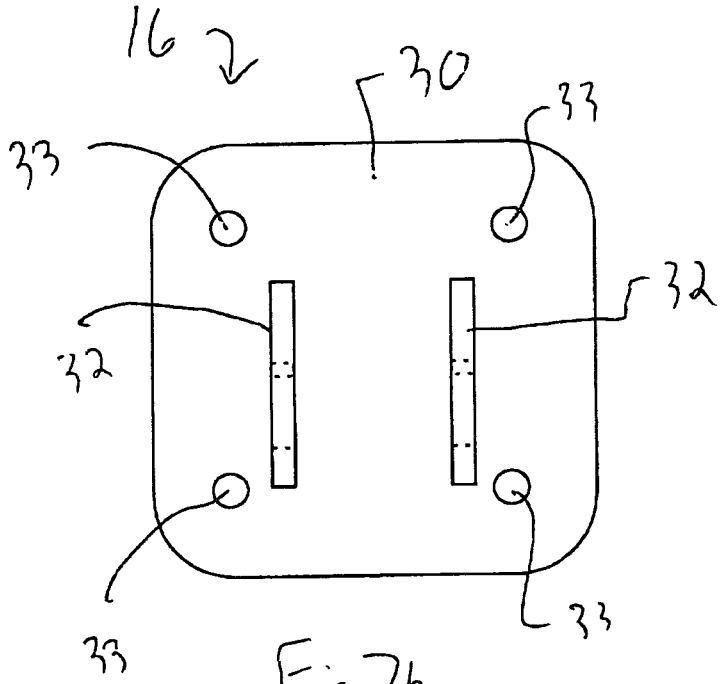
FIG. 7*b* is a top view of an upper truss attachment bracket component of a louver style roof system, consistent with an embodiment of the present invention.
Figure 8A:
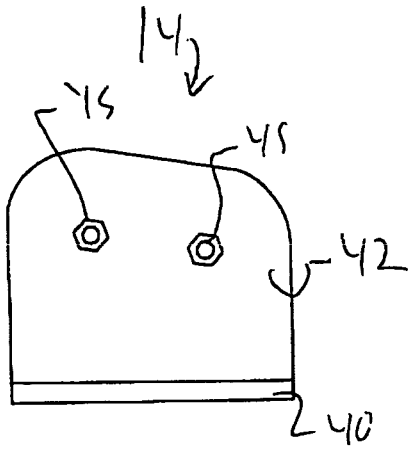
FIG. 8*a* is a side view of a lower truss attachment bracket component of a louver style roof system, consistent with an embodiment of the present invention.
Figure 8B:
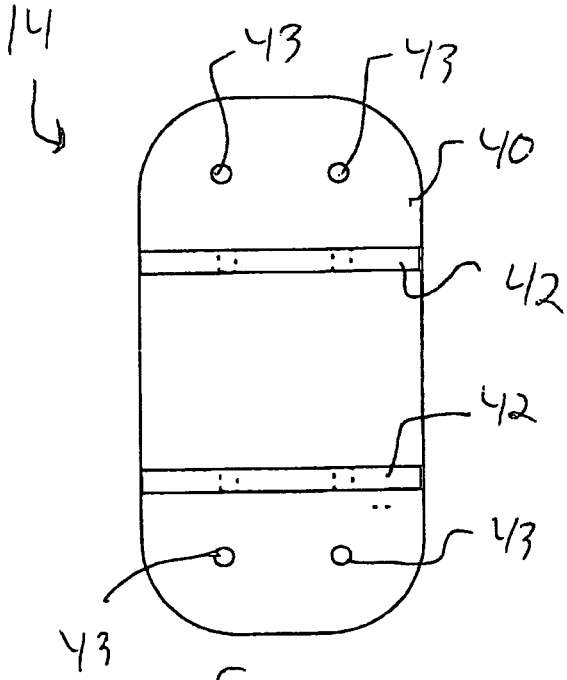
FIG. 8*b* is a top view of a lower truss attachment bracket component of a louver style roof system, consistent with an embodiment of the present invention.

Referring first to FIG. 6, a truss 12 is illustrated. The truss 12, in this embodiment, comprises a truss body 20, and a series of spaced louver panel supports 22 projecting upward therefrom. The panel supports 22 preferably have a notch 24 in an upper, side portion thereof. As will be discussed in more detail below, the notch 24 receives an upper portion of a louver panel 18. Preferably, as best seen in FIGS. 3-4 and 6, the panel supports 22 are coupled at a slightly acute angle to the truss body 20.

At one end of the truss body 20, a louver panel receiver 26 is provided. The receiver 26, as described in more detail below, receives a lower portion of a louver panel 18.

Figure 3:
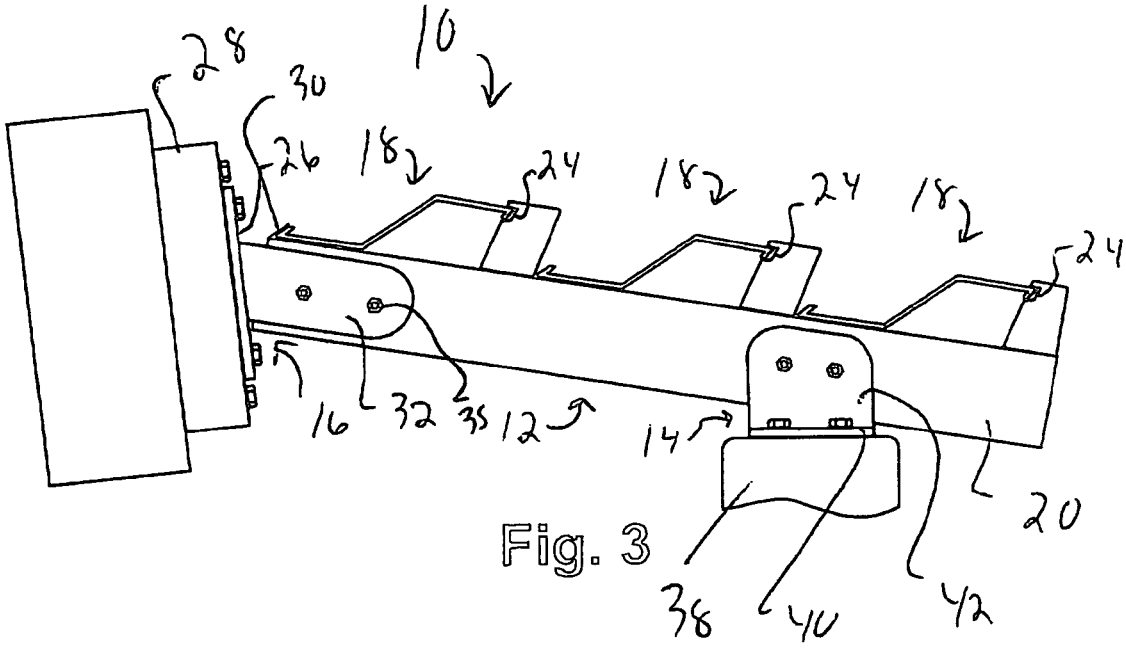
FIG. 3 is a side view of a section of a louver style roof system, consistent with an embodiment of the present invention, shown coupled to a structure.
Figure 4:
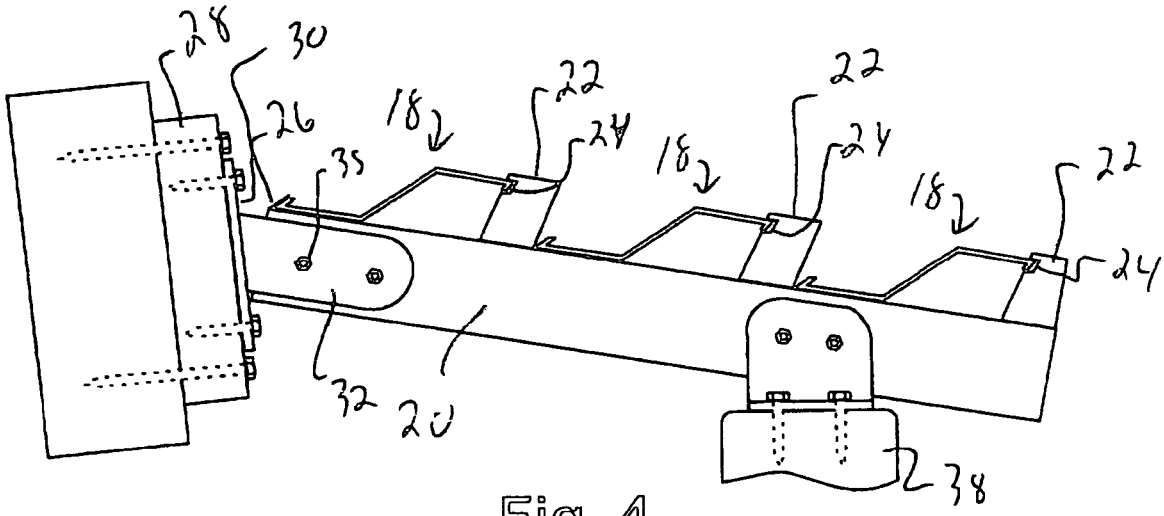
FIG. 4 is a side, cross-sectional view of the louver style roof system of FIG. 3.

Referring now to FIGS. 3-4 and 7*a*-*b*, the truss supports 20 may be coupled to a wood panel 28 or other desired structure utilizing upper truss attachment brackets 16. In the embodiment shown in FIGS. 7*a-b*, the upper truss attachment bracket 16 has a base plate 30, which is preferably provided with a plurality of openings 33 therein, to facilitate the securing thereof to the wood panel 28 (see, e.g., FIGS. 3-4). The upper truss attachment bracket 16 further includes two arms 32 projecting from the base 30. The arms 32 are spaced sufficiently far apart to permit the insertion therebetween of an end of a truss body 20, as shown in FIGS. 3-4. Securing of the end of the truss body 20 to the arms 32 may be accomplished by, for example, the securing of bolts 35 through mating openings in the truss body 20 and arms 32.

It should be noted that there are myriad ways in which coupling of the truss body 20 to a wood panel 28 or other structure could be accomplished, and the method described herein is intended to be exemplary only. For example, the upper truss attachment bracket 16 could be integrated into the truss body 20, instead of providing them as separate components. If they are to be separate components, the mechanics of coupling and attachment between them can be accomplished in any of a number of ways known in the art generally.

Referring now to FIGS. 3-4 and 8*a-b*, the truss supports 20 may be coupled to a wood beam 38 or other desired structure utilizing lower truss attachment brackets 14. In the embodiment shown in FIGS. 8*a-b*, the lower truss attachment bracket 14 has a base plate 40, which is preferably provided with a plurality of openings 43 therein to facilitate the securing thereof to the wood beam 38 (see, e.g., FIGS. 3-4). The lower truss attachment bracket 14 further includes two arms 42 projecting from the base 40. The arms 42 are spaced sufficiently far apart to permit the insertion therebetween of portion of the truss body 20, as shown in FIGS. 3-4. Securing of the truss body 20 to the arms 42 may be accomplished by, for example, the securing of bolts 45 through mating openings in the truss body 20 and arms 42.

As noted above with respect to the upper truss support attachment bracket 16, it should be noted that there are myriad ways in which coupling of the truss body 20 to a wood beam 38 or other structure could be accomplished, and the method described herein is intended to be exemplary only. For example, the lower truss attachment bracket 14 could be integrated into the truss body 20, instead of providing them as separate components. If they are to be separate components, the mechanics of coupling and attachment between them can be accomplished in any of a number of ways known in the art generally.

Figure 5:
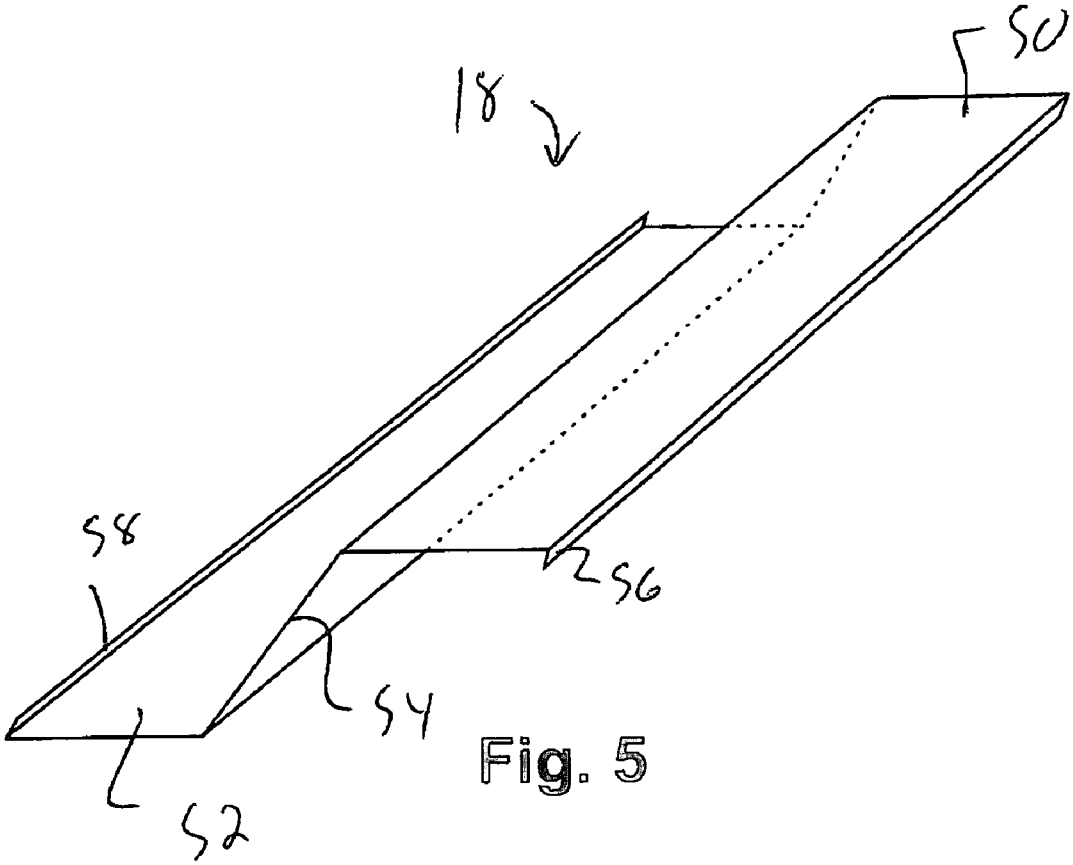
FIG. 5 is a perspective view of a louver panel component of a louver style roof system, consistent with an embodiment of the present invention.

Referring now to FIG. 5, a louver panel 18 is shown. Preferably, the louver panel 18 is shaped to have an upper horizontal section 50, a lower horizontal section 52, and an angled section 54 therebetween. The upper horizontal section 50, in this embodiment, terminates in a downward protruding tab 56. The lower horizontal section 52, in this embodiment, terminates in an upward protruding tab 58.

The louver panels 18 are preferably formed form sheet metal, though plastic or other desired materials may be utilized. Preferably, to facilitate the coupling and de-coupling of the louver panels 18 to the truss supports 20 as herein described, it may be preferred to form the louver panels 18 from a material having some flexibility.

Figure 2:
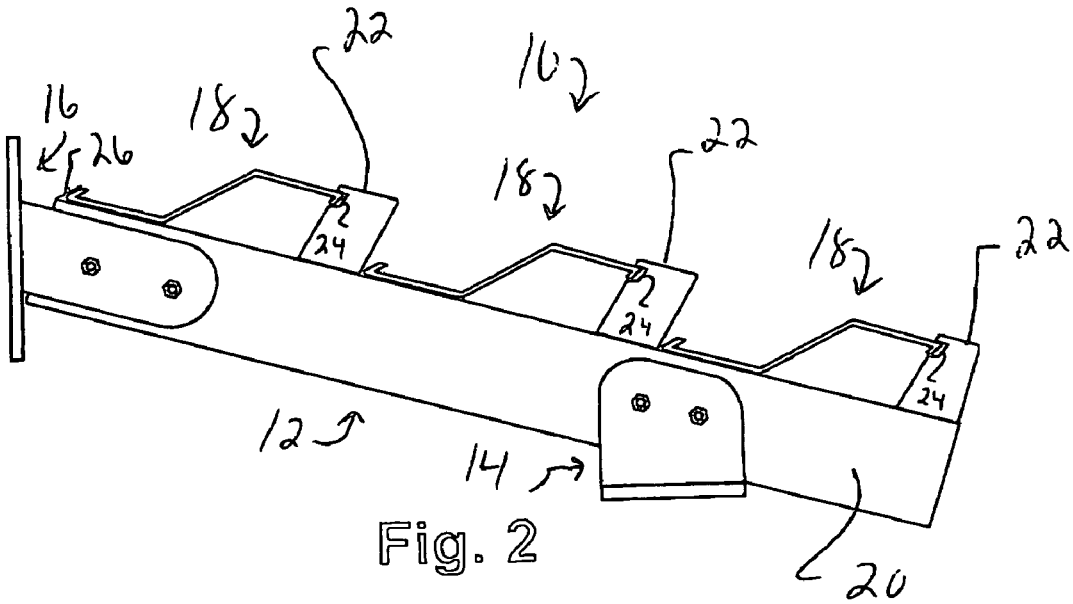
FIG. 2 is a side view of a section of a louver style roof system, consistent with an embodiment of the present invention.

Referring now to FIGS. 1-4, coupling of the louver panels 18 to the truss body 20 is described. As best seen in FIGS. 2-4, the louver panel 18 which is coupled at the end of the truss body 20 that has the receiver 26 thereon is positioned to that the upward protruding tab 58 is inserted into the receiver 26. The downward protruding tab 56 of the same louver panel 18 is inserted into notch 24 of the most proximate panel supports 22. Secure coupling of the louver panel 18 may require some bending or flexing of the louver panel 18 during the coupling process. It can be seen that, as described herein, louver panels 18 may, in this embodiment, be attached to the truss supports 20 without any additional hardware.

For the next louver panel 18, it is positioned so that its upward protruding tab 58 abuts the rear side of the support 22 which has received on an opposite side thereof the upward protruding tab 56 of the end louver panel 18. The downward protruding tab 56 of the second louver panel 18 is inserted into notch 24 of the next set of panel supports 22. The process continues, until the desired number of louver panels 18 has been installed.

As best seen in FIG. 1, when the louver panels 18 are in position, there remains a gap 60 between each succeeding pair of louver panels 18. During the part of the day when the sun is relatively low over the horizon, the suns rays enter through gap 60. When the sun is more directly above the roof, the rays will contact the upper portion of the lover panels 18, and will be substantially blocked from entering the gap 60—reducing heat below the roof as compared to prior art, slat systems.

I claim:

1. A patio-style roof system comprising, in combination:

at least two trusses;

wherein each of the at least two trusses comprises a truss body and a series of spaced louver panel supports projecting upward therefrom;

wherein the spaced louver panel supports have a notch in an upper, side portion thereof;

wherein the panel supports are coupled at acute angles to the truss body;

means for securing the at least two trusses to a structure;

wherein the securing means comprise an upper truss attachment bracket and a lower truss attachment bracket;

a plurality of louver panels detachably coupled to the louver panel supports;

wherein the louver panels comprise an upper horizontal section, a lower horizontal section, and an angled section therebetween; and a downward protruding tab extending below the upper horizontal section, and wherein the downward protruding tab is dimensioned to be inserted into the notch;

wherein when the downward protruding tab is inserted into the notch, the upper horizontal section extends laterally beyond the panel support and is substantially parallel to the truss body.

2. The system of claim 1 wherein the louver panels are flexible.

3. The system of claim 2 wherein the louver panels are fabricated from sheet metal.

* * * * *